US008416921B2

(12) United States Patent
Nakazawa et al.

(10) Patent No.: US 8,416,921 B2
(45) Date of Patent: Apr. 9, 2013

(54) X-RAY CONVERGENCE ELEMENT AND X-RAY IRRADIATION DEVICE

(75) Inventors: Hiromoto Nakazawa, Tsukuba (JP); Hideki Yoshikawa, Tsukuba (JP); Aurel-Mihai Vlaicu, Tsukuba (JP); Kenichi Obori, Kyoto (JP); Shintaro Komatani, Kyoto (JP); Sumito Ohzawa, Kyoto (JP)

(73) Assignees: Horiba, Ltd., Kyoto (JP); National Institute for Materials Science, Ibaraki (JP)

( * ) Notice: Subject to any disclaimer, the term of this patent is extended or adjusted under 35 U.S.C. 154(b) by 0 days.

(21) Appl. No.: 12/280,136

(22) PCT Filed: Feb. 8, 2007

(86) PCT No.: PCT/JP2007/052209
§ 371 (c)(1),
(2), (4) Date: Feb. 27, 2009

(87) PCT Pub. No.: WO2007/097202
PCT Pub. Date: Aug. 30, 2007

(65) Prior Publication Data

US 2010/0226477 A1 Sep. 9, 2010

(30) Foreign Application Priority Data

Feb. 21, 2006 (JP) ..... 2006-043960

(51) Int. Cl.
*G21K 1/06* (2006.01)

(52) U.S. Cl. ..... 378/145; 378/84

(58) Field of Classification Search ..... 378/84–85, 378/147, 145
See application file for complete search history.

(56) References Cited

U.S. PATENT DOCUMENTS

| | | | | |
|---|---|---|---|---|
| 3,898,455 | A | 8/1975 | Furnas, Jr. | |
| 4,940,319 | A | 7/1990 | Ueda et al. | |
| 5,768,339 | A * | 6/1998 | O'Hara | 378/147 |
| 6,442,236 | B1 | 8/2002 | Utaka | |
| 7,403,593 | B1 * | 7/2008 | He et al. | 378/85 |

FOREIGN PATENT DOCUMENTS

| | | |
|---|---|---|
| DE | 101 39 384 | 3/2003 |
| JP | 63-192000 | 8/1988 |

(Continued)

OTHER PUBLICATIONS

German Patent Application No. 11200700422.3 Office Action dated Oct. 29, 2010, 4 pages including English translation.

*Primary Examiner* — Hoon Song

(57) ABSTRACT

An X-ray convergence element and an X-ray irradiation device including the X-ray convergence element are provided. The X-ray convergence element can extend a working distance from an exit-side opening end thereof to a specimen, and can perform analysis of the specimen with rough surface, a fluorescent X-ray analysis, and a X-ray diffraction analysis, regardless of a size of the specimen. An X-ray blocking member 23 is provided with three supporting members 233 for supporting the X-ray blocking member 23, which extend from an annular member 232 having approximately the same diameter as a diameter of an entrance-side opening end (outer diameter of a capillary 20) toward the center of the X-ray blocking member 23 to fix the annular member 232 to the capillary 20. The annular member 232, the supporting members 233, and the X-ray blocking member 23 are integrally formed of a metal that shields X-rays, such as tantalum, tungsten, or molybdenum. A dimension of the X-ray blocking member 23 in the axial direction (thickness) is set to be sufficient for blocking X-rays.

11 Claims, 9 Drawing Sheets

FOREIGN PATENT DOCUMENTS

| | | |
|---|---|---|
| JP | 01-185498 | 7/1989 |
| JP | 1-276100 | 11/1989 |
| JP | 01-292297 | 11/1989 |
| JP | 06-300897 | 10/1994 |
| JP | 2001-085192 | 3/2001 |
| JP | 2001-343511 | 12/2001 |

* cited by examiner

X-RAY CONVERGENCE ELEMENT AND X-RAY IRRADIATION DEVICE

RELATED APPLICATIONS

This application is a National Phase Application of PCT International Application No. PCT/JP2007/052209, which has an International filing date of Feb. 8, 2007, and which designated the United States of America.

TECHNICAL FIELD

The present invention relates to an X-ray convergence element including a tubular body, for reflecting X-rays entered into the tubular body, and for converging the reflected X-rays, and to an X-ray irradiation device including the X-ray convergence element.

BACKGROUND ART

For various purposes, such as research and development including development of materials or examination of living bodies, quality management including foreign object analyses or defect analyses, or the like, an X-ray analyzing device is utilized for irradiating X-rays onto a sample, detecting fluorescent X-rays emitted from the sample, transmitted X-rays through the sample, diffracted X-rays, or the like, and analyzing an internal composition or crystal structure of the sample. Some X-ray analyzing devices may reflect and converge X-rays irradiated from an X-ray source by an X-ray mirror to irradiate focused X-rays onto the sample.

However, in the case of the X-ray analyzing device adopting an X-ray mirror, for example, in order to make a diameter of an X-ray beam irradiated to the sample approximately 1 μm, it has disadvantages that a high processing accuracy of an X-ray mirror surface is required to prevent scattering of the X-rays on the mirror surface, and that a temperature control is needed to reduce an influence of a thermal strain caused by energy of the incident X-rays onto the mirror surface. Because an X-ray tube (capillary) used for solving the disadvantages is formed of a narrow and long glass tube, the influence of the thermal strain can be reduced with an axially-symmetrical structure, and X-rays can be converged to higher density with a simple structure.

As an example of the X-ray tube, an X-ray tube is proposed in which X-rays enter from one opening end of the X-ray tube, and the entered X-rays are totally reflected on an inner surface of the X-ray tube to exit the X-rays from the other opening end toward the sample to converge the X-rays onto the sample. In addition, it is known that the inner surface of the X-ray tube is formed in a rotating paraboloid or a rotating ellipsoid to further improve X-ray convergeability (refer to Japanese Patent Application Laid-Open No. 2001-85192).

SUMMARY OF THE INVENTION

However, in the X-ray tube, according to Japanese Patent Application Laid-Open No. 2001-85192, because both ends of the X-ray tube are open, in order to prevent the entering X-rays from one opening end of the X-ray tube from directly exiting from the other opening end without being reflected inside the X-ray tube, a diameter of the other opening end on the exit side is needed to be reduced in size. Although the diameter of the other opening end on the exit side is reduced, the distance to converge the exiting X-rays is shortened to make it difficult to sufficiently ensure a working distance (WD) from the opening end on the exit side to a specimen (e.g., approximately 0.1 mm). Therefore, there arise problems in which a sample (specimen) with rough surface cannot be analyzed, a takeoff angle of fluorescent X-rays emitted from the sample cannot be ensured, diffraction of X-rays cannot be sufficiently analyzed, because the sample cannot be rotated or inclined.

The present invention is made in view of the conditions described hereinabove, and provides an X-ray convergence element and an X-ray irradiation device including the X-ray convergence element. The X-ray convergence element includes a tubular body in which a diameter of an entrance-side opening end thereof is greater than that of the exit-side opening end, and an X-ray blocking member having a diameter that is approximately the same as the diameter of the exit-side opening end, the center of which being arranged on the center axis of the tubular body. Therefore, a working distance from the exit-side opening end to the specimen can be extended, and an analysis of the specimen with rough surface, a fluorescent X-ray analysis, and an X-ray diffraction analysis can be performed regardless of a size of the specimen.

Another object of the present invention is to provide an X-ray convergence element and an X-ray irradiation device including the X-ray convergence element in which the X-ray blocking member is supported by a plurality of supporting members extending from an annular member fixed in proximity to the entrance-side opening end toward the center of the X-ray blocking member. Therefore, unnecessary X-rays can be blocked with a simple structure.

Still another object of the present invention is to provide an X-ray convergence element and an X-ray irradiation device including the X-ray convergence element in which the X-ray blocking member is a plate-like body. The diameter of the X-ray blocking member being narrowed toward the X-ray entering side. Therefore, entering of unnecessary scattered X-rays can be prevented.

Another object of the present invention is to provide an X-ray convergence element and an X-ray irradiation device including the X-ray convergence element in which the X-ray blocking member has an X-ray incident surface that is a part of a spherical surface. Therefore, entering of unnecessary scattered X-rays can be prevented.

Another object of the present invention is to provide an X-ray convergence element and an X-ray irradiation device including the X-ray convergence element in which the X-ray blocking member forms a spherical body, and the X-ray convergence element includes a plurality of fixing members for fixing the X-ray blocking member to the tubular body between an inner surface of the tubular body and a surface of the X-ray blocking member. Therefore, the center of the X-ray blocking member can be easily arranged on the axis of the tubular body.

Another object of the present invention is to provide an X-ray convergence element and an X-ray irradiation device including the X-ray convergence element in which the fixing members form spherical bodies. Therefore, the center of the X-ray blocking member can be easily arranged on the center axis of the tubular body with a simple structure.

Another object of the present invention is to provide an X-ray convergence element and an X-ray irradiation device including the X-ray convergence element in which the fixing members are stick-like bodies arranged so as to be spaced from each other with a predetermined distance in the circumferential direction of the tubular body. Therefore, the center of the X-ray blocking member can be easily arranged on the center axis of the tubular body with a simple structure.

Another object of the present invention is to provide an X-ray convergence element and an X-ray irradiation device including the X-ray convergence element in which the X-ray convergence element includes an X-ray transmitting sheet for fixing the X-ray blocking member to the entrance-side opening end. Therefore, unnecessary X-rays can be blocked with a simple structure, while more X-rays are converged.

According to a first aspect of the invention, an X-ray convergence element includes a tubular body, X-rays entering from one side opening end thereof, the entered X-rays being reflected on an inner surface of the tubular body, and the reflected X-rays exit from the other side opening end while being converged. A diameter of the entrance-side opening end is greater than that of the exit-side opening end. The X-ray convergence element includes an X-ray blocking member having approximately the same diameter as the diameter of the exit-side opening end. The center of the X-ray blocking member is arranged on the center axis of the tubular body.

According to a second aspect of the invention, the X-ray convergence element may further include an annular member fixed in proximity to the entrance-side opening end, and a plurality of supporting members extending from the annular member toward the center of the X-ray blocking member to support the X-ray blocking member.

According to a third aspect of the invention, the X-ray blocking member may be a plate-like body, and a diameter of the X-ray blocking member may be narrowed toward the X-ray entering side.

According to a fourth aspect of the invention, the X-ray blocking member may have an X-ray incident surface that is a part of a spherical surface.

According to a fifth aspect of the invention, the X-ray blocking member may form a spherical body. The X-ray convergence element may include a plurality of fixing members for fixing the X-ray blocking member to the tubular body between an inner surface of the tubular body and a surface of the X-ray blocking member.

According to a sixth aspect of the invention, the fixing members may be spherical bodies arranged so as to be spaced from each other in the circumferential direction of the tubular body.

According to a seventh aspect of the invention, the fixing members may be spaced from each other with a predetermined distance in the circumferential direction of the tubular body. The fixing members may be stick-like bodies arranged approximately parallel to each other in the axial direction of the tubular body.

According to an eighth aspect of the invention, the X-ray convergence element may further include an X-ray transmitting sheet for fixing the X-ray blocking member at the exit-side opening end.

According to a ninth aspect of the invention, an X-ray irradiation device includes an X-ray convergence element for converging X-rays irradiated from an X-ray source, and irradiating the converged X-rays. The X-ray convergence element may be the X-ray convergence element according to any of the aspects of the invention described above.

According to the first and ninth aspects of the invention, the inner surface of the tubular body may be, for example constructed to be a rotating paraboloid or a rotational ellipsoid about the center axis of the tubular body. X-rays entering into the entrance-side opening end of the tubular body parallel to the center axis are totally reflected on the inner surface of the tubular body when they are incident onto the inner surface of the tubular body at a smaller incident angle than the total reflected optimal angle. The reflected X-rays exit from the exit-side opening end so as to be converged at a focal point, which may be formed by the rotating paraboloid or rotational ellipsoid of the inner surface of the tubular body. The diameter of the entrance-side opening end of the tubular body is greater than that of the exit-side opening end. The X-ray blocking member having approximately the same diameter as the diameter of the exit-side opening end is arranged so as to have its center on the center axis of the tubular body. Therefore, the X-ray blocking member blocks the entering X-rays which may pass through the tubular body without being reflected on the inner surface of the tubular body, and, thus, it prevents the X-rays from directly exiting from the exit-side opening end. The entered X-rays which are not blocked by the X-ray blocking member are totally reflected on the inner surface of the tubular body, and exit from the exit-side opening end so as to be converged at the focal point.

The diameter of the exit-side opening end of the tubular body is approximately the same as the diameter of the X-ray blocking member. Therefore, the diameter of the exit-side opening end of the tubular body is not needed to be a very small to irradiate a microscopical X-ray beam onto a specimen. Thus, the diameter of the exit-side opening end of the tubular body may be increased to extend a distance (i.e., an working distance) from the exit-side opening end to the focal point at which the X-rays are converged.

According to the second and ninth aspects of the invention, the plurality of supporting members for supporting the X-ray blocking member extend from an annular member toward the center of the X-ray blocking member. The annular member is fixed in proximity to the entrance-side opening end. Therefore, the X-ray blocking member is fixed to the tubular body so that the center of the X-ray blocking member is located on the center axis of the tubular body.

According to the third and ninth aspects of the invention, the X-ray blocking member is a plate-like body, and is narrowed toward the X-ray entering side. If the diameter of the X-ray blocking member is smaller than the diameter of the entrance-side opening end, X-rays entering from the entrance-side opening end may be reflected on a side surface of the X-ray blocking member in the axial direction to be unnecessary scattered X-rays. Thus, the greater a dimension in the axial direction of the X-ray blocking member is, the more the scattered X-rays are increased. By narrowing the diameter of the X-ray blocking member toward the X-ray entering side, a traveling direction of the entered X-rays can be significantly changed, and thereby preventing the unnecessary scattered X-rays reflected on the side surface from entering into the inner surface of the tubular body.

According to the fourth and ninth aspects of the invention, the X-ray blocking member has an X-ray incident surface that is a part of a spherical surface to eliminate the side-surface portion parallel to the axial direction of the X-ray blocking member. Therefore, X-rays that are incident to the X-ray blocking member are prevented from entering to the inner surface of the tubular body as an unnecessary scattered X-ray.

According to the fifth and ninth aspects of the invention, the X-ray blocking member forms a spherical body. A plurality of fixing members for fixing the X-ray blocking member to the tubular body are provided between the inner surface of the tubular body and the surface of the X-ray blocking member. Therefore, the center of the X-ray blocking member is easily arranged on the center axis of the tubular body.

According to the sixth and ninth aspects of the invention, the fixing members are spherical bodies arranged so as to be spaced from each other with a predetermined distance in the circumferential direction of the tubular body. Therefore, if the diameters of the spherical bodies are the same, the center of the X-ray blocking member is arranged on the center axis of the tubular body.

According to the seventh and ninth aspects of the invention, the fixing members are spaced from each other with a predetermined distance in the circumferential direction of the tubular body, and are stick-like bodies arranged approximately parallel to each other in the axial direction of the tubular body. Therefore, if the diameters or thicknesses of the stick-like bodies are the same, the center of the X-ray blocking member is arranged on the center axis of the tubular body.

According to the eighth and ninth aspects of the invention, the X-ray transmitting sheet may be provided for fixing the X-ray blocking member at the entrance-side opening end. Therefore, unnecessary X-rays are blocked by the X-ray blocking member, while transmitting more X-rays through the X-ray transmitting sheet.

According to the first and ninth aspects of the invention, the diameter of the entrance-side opening end of the tubular body is greater than that of the exit-side opening end. The X-ray blocking member having approximately the same diameter as the diameter of the exit-side opening end is provided. The center of the X-ray blocking member is arranged on the center axis of the tubular body. Therefore, the entered X-rays do not directly exit from the exit-side opening end without being totally reflected on the inner surface of the tubular body. In addition, the diameter of the exit-side opening end can be increased, and the working distance from the exit-side opening end to the specimen can be extended. By extending the working distance, the X-rays can be irradiated onto a desired position of the specimen even if the specimen has a rough surface. In addition, a sufficient takeoff angle of fluorescent X-rays emitted from the specimen can be ensured, and the specimen can be rotated at a desired angle or moved for a desired distance. Therefore, an analysis of the specimen, a fluorescent X-ray analysis, and a X-ray diffraction analysis can be performed regardless of a size of the specimen.

According to the second and ninth aspects of the invention, by supporting the X-ray blocking member with a plurality of the supporting members extending from the annular member fixed in proximity to the entrance-side opening end toward the center of the X-ray blocking member, unnecessary X-rays can be blocked with a simple structure.

According to the third and ninth aspects of the invention, the X-ray blocking member is the plate-like body, and the diameter of the X-ray blocking member is narrowed toward the X-ray entering side. Therefore, unnecessary scattered X-rays can be prevented from entering.

According to the fourth and ninth aspects of the invention, the X-ray blocking member has the X-ray incident surface that is a part of the spherical surface. Therefore, unnecessary scattered X-rays can be prevented from entering.

According to the fifth and ninth aspects of the invention, the X-ray blocking member forms a spherical body. The plurality of fixing members for fixing the X-ray blocking member to the tubular body are provided between the inner surface of the tubular body and the surface of the X-ray blocking member. Therefore, the center of the X-ray blocking member is easily arranged on the center axis of the tubular body.

According to the sixth and ninth aspects of the invention, the fixing members are spherical bodies arranged so as to be spaced from each other with a predetermined distance in the circumferential direction of the tubular body. Therefore, the center of the X-ray blocking member is easily arranged on the center axis of the tubular body.

According to the seventh and ninth aspects of the invention, the fixing members are spaced from each other with a predetermined distance in the circumferential direction of the tubular body, and are stick-like bodies arranged approximately parallel to each other in the axial direction of the tubular body. Therefore, the center of the X-ray blocking member is easily arranged on the canter axis of the tubular body.

According to the eighth and ninth aspects of the invention, the X-ray transmitting sheet is provided for fixing the X-ray blocking member at the entrance-side opening end. Therefore, unnecessary X-rays are blocked by the X-ray blocking member with a simple structure, while transmitting more X-rays through the X-ray transmitting sheet.

BEST MODES FOR IMPLEMENTING THE INVENTION

Embodiment 1

Figure 1:
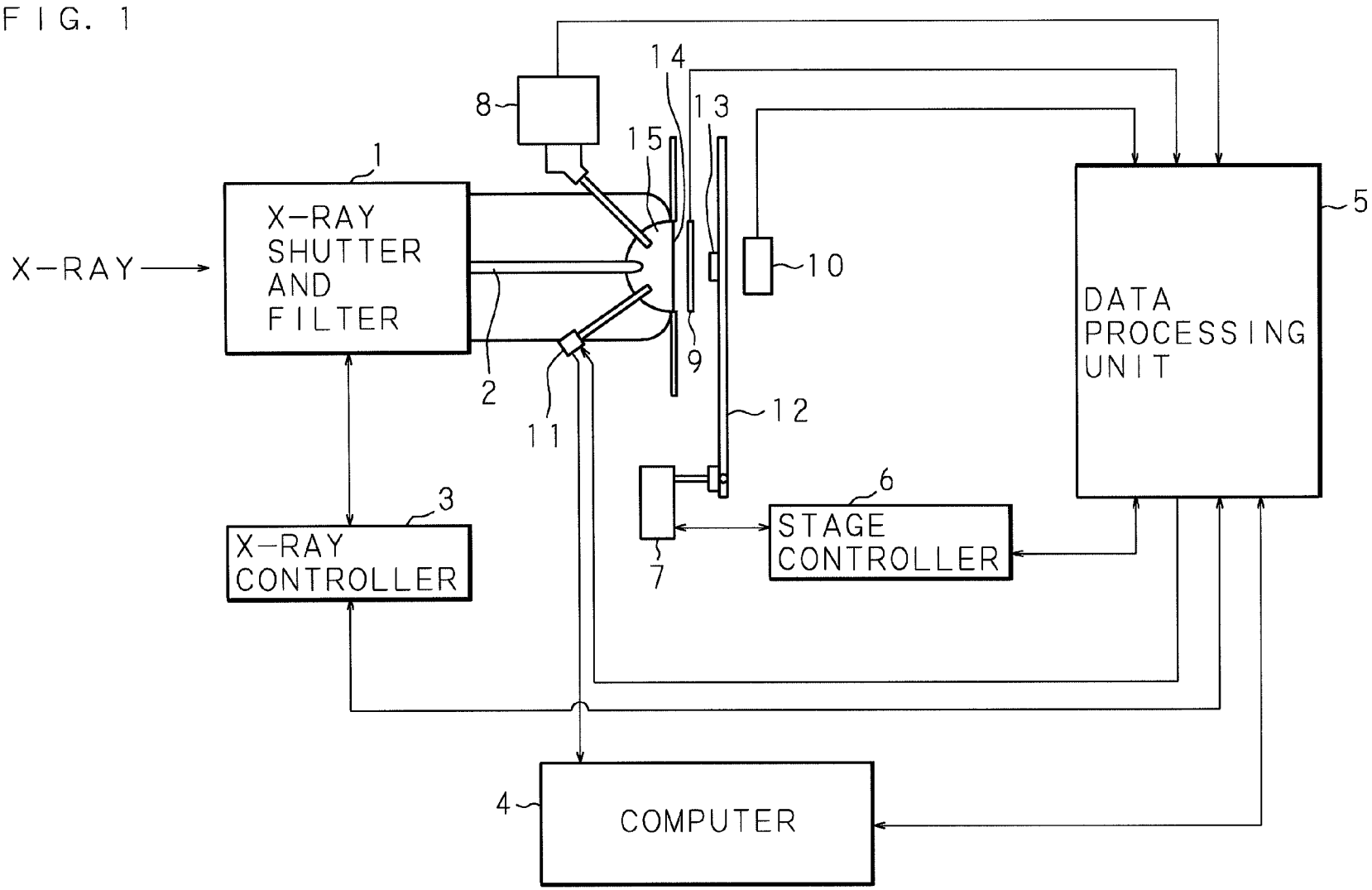
FIG. 1 is a block diagram showing a configuration of an X-ray analyzing device including an X-ray convergence element, according to the present invention.

Hereinafter, the present invention will be described based on the appending drawings illustrating embodiments thereof. FIG. 1 is a block diagram showing a configuration of an X-ray analyzing device including an X-ray convergence element according to the present invention. In this figure, the reference numeral 1 indicates an X-ray shutter and filter for controlling ON/OFF of X-rays and an output intensity of X-rays. An X-ray convergence element 2 is attached to the X-ray shutter and filter 1. A parallel X-ray beam exiting from the X-ray shutter and filter 1 enters into the X-ray convergence element 2, the X-ray convergence element 2 totally reflects the entered X-rays on an inner surface of the X-ray convergence element 2 to converge the X-rays. Then, a diameter of the beam is narrowed by, for example 1 μm order, while leading the X-rays to an opening 15 provided in proximity to a sample stage 12.

In this embodiment, the opening 15 is a space closed with an X-ray transmitting body 14, and an inside of the space is a vacuum. In this case, the vacuum space is formed in the opening 15 by sectioning the sample stage 12 and the opening 15 by the X-ray transmitting body 14. The opening 15 may be a space in atmosphere, and the entire space including the sample stage 12 may also be a vacuum space. However, it is preferable that an X-ray irradiated space is maintained to be a vacuum to prevent attenuation of secondary X-rays.

In the opening 15, an exit-side opening end of the X-ray convergence element 2 is arranged. Also inside the opening 15, a tip-end portion of a fluorescent X-ray detector 8 is arranged for detecting a fluorescent X-ray emitted from a sample (specimen) 13 to which the X-rays are irradiated. In addition, a photo-receiving portion of an imaging device 11 for imaging the sample 13 placed on the sample stage 12 is provided inside the opening 15.

For example, below the X-ray transmitting body 14, an annular diffracted X-ray detector 9 for detecting diffracted X-rays is arranged. On the opposite side of the sample stage 12 from where the sample 13 is arranged, a transmitted X-ray detector 10 for detecting X-rays transmitted through the sample 13. The diffracted X-ray detector 9 is not limited to the annular shape, and may also be in a shape other than the annular shape.

A motor 7 is attached to the sample stage 12. The motor 7 moves the sample stage 12 in two directions that are parallel to the surface of the sample stage 12 where the sample 13 is arranged and are perpendicular to each other (X-direction and Y-direction), while rotating the X-ray irradiating direction against the sample 13 to a desired angle. The motor 7 moves the sample stage 12 in a normal direction of the surface of the sample stage 12 where the sample 13 is arranged to adjust a distance between the opening 15 and the sample stage 12. Upon analyzing the diffracted X-rays, stages that rotate about three axes R, θ, and ϕ (not illustrated) will be further used.

A stage controller 6 is connected to the motor 7, and the stage controller 6 controls the motor 7 to control a position of the sample 13 placed on the sample stage 12.

An X-ray controller 3 is connected to the X-ray shutter and filter 1, and the X-ray controller 3 performs opening/closing of the shutter and switching of the filter to control the ON/OFF of the X-rays and the output intensity of the X-rays.

A data processing unit 5 is connected to the imaging device 11, the X-ray controller 3, and the stage controller 6. The data processing unit 5 transmits a control signal to the imaging device 11, the X-ray controller 3, and the stage controller 6 via a communication interface module (not illustrated) to control operations of the imaging device 11, the X-ray controller 3, and the stage controller 6, respectively. In addition, a computer 4, as well as the fluorescent X-ray detector 8, the diffracted X-ray detector 9, and the transmitted X-ray detector 10, are connected to the data processing unit 5 via the communication interface module.

When the data processing unit 5 receives a control parameter of the X-ray shutter and filter 1 from the computer 4, the data processing unit 5 generates a control signal corresponding to the received parameter, and then transmits it to the X-ray controller 3. The X-ray controller 3 controls ON/OFF of the generated X-rays by the X-ray shutter and filter 1 based on the received control signal, while controlling the output intensity of the X-rays.

When the data processing unit 5 receives a control parameter of the imaging device 11 from the computer 4, the data processing unit 5 generates a control signal corresponding to the received parameter, and then transmits it to the imaging device 11. The imaging device 11 captures an image of the sample 13 placed on the sample stage 12 based on the received control signal, and then transmits the captured image (including a still image) to the computer 4.

When the data processing unit 5 receives a control parameter of the sample stage 12 from the computer 4, the data processing unit 5 generates a control signal corresponding to the received parameter, and then transmits it to the stage controller 6. The stage controller 6 drives the motor 7 based on the received control signal, and moves or rotates the sample stage 12. For example, the data processing unit 5 transmits the sample image captured by the imaging device 11 to the computer 4, and causes a displaying unit (not illustrated) of the computer 4 to display the captured image. When a predetermined operation button on a screen is operated, the data processing unit 5 receives the control parameter of the sample stage 12 from the computer 4. In the result, a position of the sample 13 can be controlled, while viewing the captured image of the sample 13 displayed on the displaying unit of the computer 4.

The data processing unit 5 receives detection signals detected by the fluorescent X-ray detector 8, the diffracted X-ray detector 9, and the transmitted X-ray detector 10 via the communication interface module (not illustrated), and performs a predetermined data processing based on the received detection signals to output the processing results to the computer 4.

The computer 4 includes a CPU, a RAM, a storage unit for storing various data, a communication unit for performing data communication with the data processing unit 5 and the like, an input/output unit, such as a mouse and a keyboard, the displaying unit, such as a display (any of units are not illustrated). The computer 4 performs a predetermined analyzing process for the sample 13 based on the output data from the data processing unit 5, and then displays the analyzing results on the displaying unit, or stores it in the storage unit (not illustrated).

Figure 2:
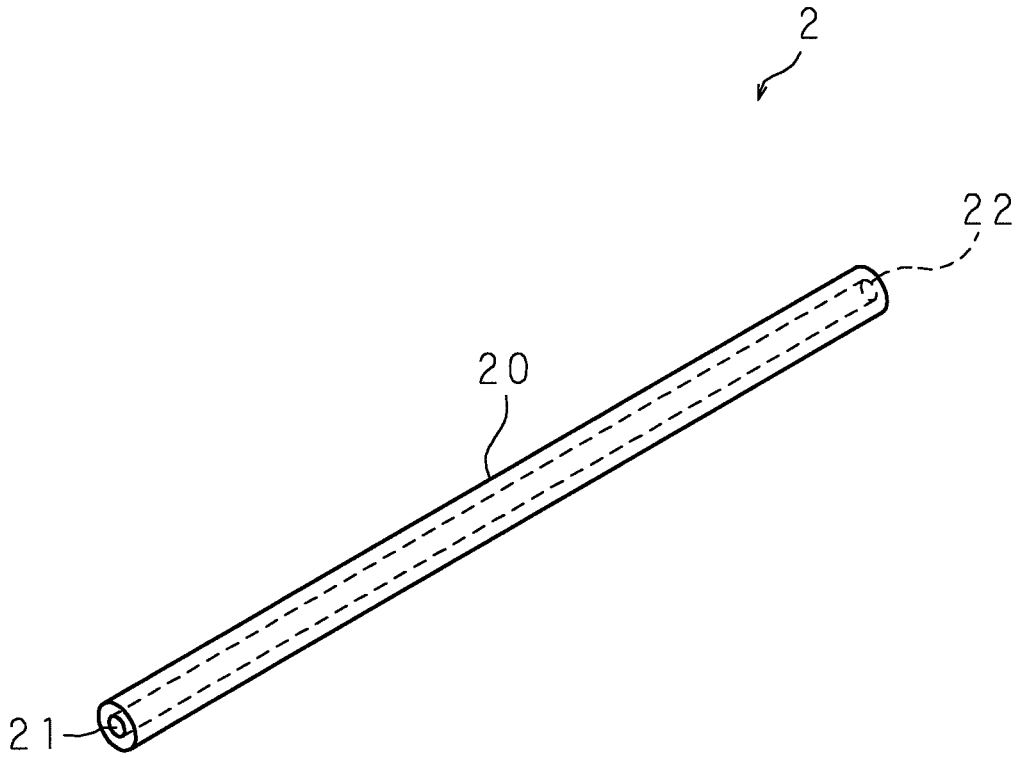
FIG. 2 is an exterior perspective view of the X-ray convergence element.

FIG. 2 is an exterior perspective view of the X-ray convergence element 2. The X-ray convergence element 2 includes a capillary (tubular body) 20 typically made of glass, and an X-ray blocking member 23 which will be described below. A length of the capillary 20 in the axial direction is, for example 100 mm or 200 mm. In this embodiment, an outer diameter of the capillary 20 on a side to which the X-rays enter is, for example, 5 mm, and a diameter of the entrance-side opening end 22 is approximately 1 mm. In addition, an outer diameter of the capillary 20 on a side from which the X-rays exit is, for example 4.6 mm, and a diameter of the exit-side opening end 21 is approximately 0.6 mm.

Figure 3:
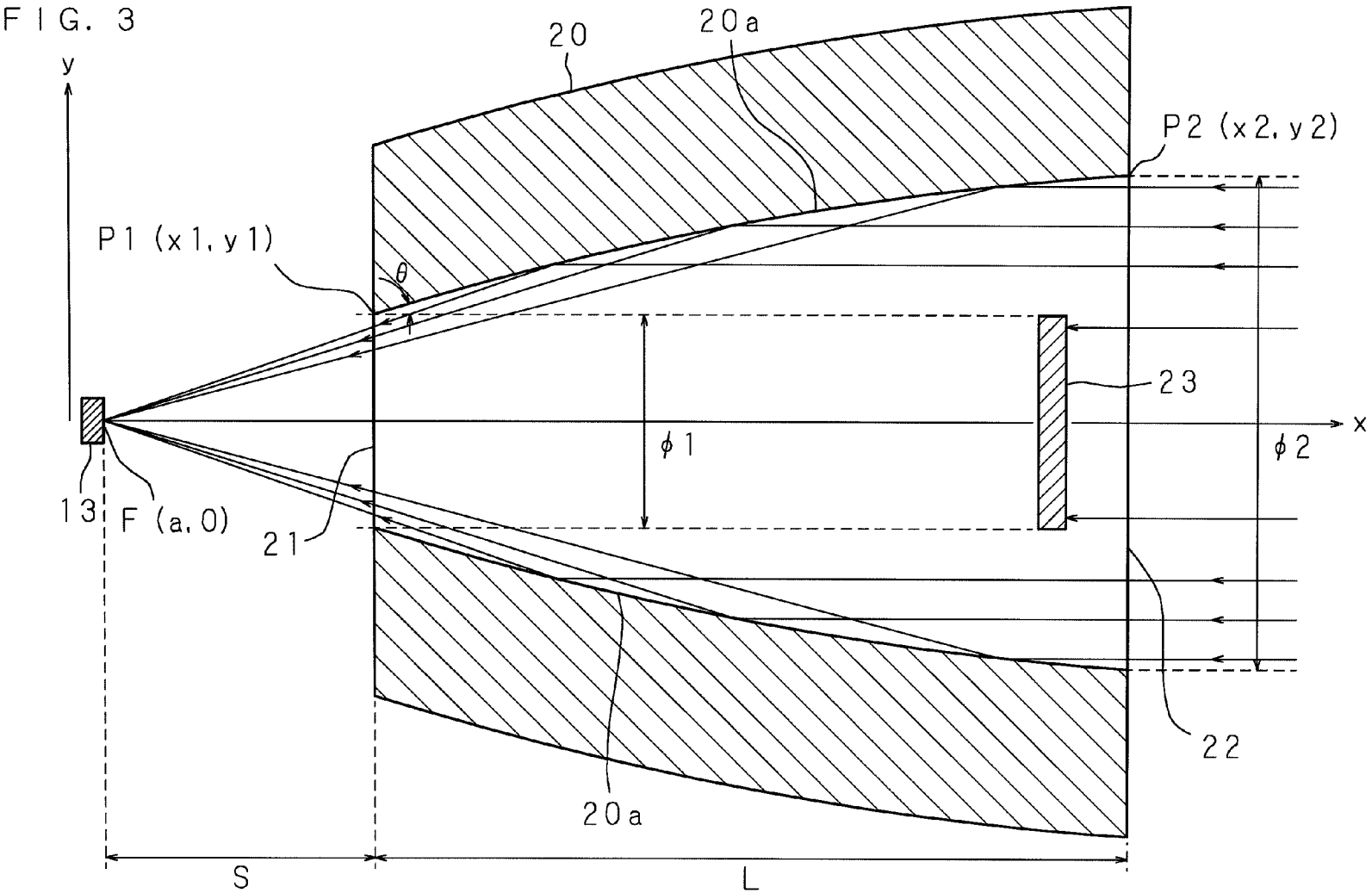
FIG. 3 is a schematic view showing a longitudinal cross-section of a capillary.

FIG. 3 is a schematic view showing a longitudinal cross-section of the capillary 20. As shown in this figure, the center axis of the capillary 20 is designated as x-axis, and a radial direction of the capillary 20 is designated as y-axis. The capillary 20 is a rotational symmetry about x-axis, and an inner surface 20*a* of the capillary 20 forms a rotating paraboloid. A diameter ϕ2 of the entrance-side opening end 22 of the capillary 20 is greater than a diameter ϕ1 of the exit-side opening end 21 (ϕ2>ϕ1), and the disk-like X-ray blocking member 23 having the same diameter as the diameter ϕ1 of the exit-side opening end 21 is provided in proximity to the entrance-side opening end 22 of the capillary 20.

The entering X-rays parallel to the center axis of the capillary 20 from the entrance-side opening end 22 (x-axis) are incident onto the inner surface 20*a* of the capillary 20 at an incident angle θ. If the incident angle θ is smaller than a total reflection optimal angle θc, the X-rays are totally reflected on the inner surface 20*a* of the capillary 20, and exit from the exit-side opening end 21 to be converged at a focal point F. The X-rays entering within the diameter ϕ1 that are centering the center axis (x-axis) are blocked by the X-ray blocking member 23. Therefore, all of the X-rays entering from the entrance-side opening end 22 are totally reflected on the inner surface 20*a* of the capillary 20, and exit from the exit-side opening end 21 to be converged at the focal point F (position of the sample 13). The X-rays are converged to a beam diameter of approximately 1 μm, for example. In the result, the X-rays do not directly exit from the exit-side opening end 21 without being totally reflected on the inner surface 20*a* of the capillary 20.

Assuming that the paraboloid of the inner surface 20*a* of the capillary 20 is $y^2=4ax$. A coordinate of a point P2 at the entrance-side opening end is P2(x2, y2), and a coordinate of a point P1 at the exit-side opening end is P1(x1, y1). In addition, an angle of the paraboloid at the point P1 with respect to x-axis is θ, and a coordinate of the focal point F on the paraboloid is F(a, 0).

As shown in the following equations, by differentiating $y^2=4ax$ with respect to x, "a" is represented by the equation (1). Here, because y' is represented by the equation (2), y' can be represented by the equation (3). By substituting the equation (3) into the equation (1), "a" can be represented by the equation (4). Assuming that the length (dimension in the axial direction) of the capillary 20 is L, y2 can be represented by the equation (5). A distance S from the exit-side opening end 21 to the focal point F can be represented by the equation (6). An X-ray convergence efficiency E can be represented by the equation (7).

$$a = \frac{1}{2} y \cdot y' \tag{1}$$

$$y' = \frac{dy}{dx} \tag{2}$$

$$y' = \tan\theta \tag{3}$$

$$a = \frac{1}{2} y \cdot \tan\theta \tag{4}$$

$$y2 = (y1^2 + 4aL)^{\frac{1}{2}} \tag{5}$$

$$S = x1 - a \tag{6}$$

$$E = \frac{y2^2 - y1^2}{y2^2} \tag{7}$$

Next, the above equations will be explained by being applied with specific values. Assuming that the length L of the capillary 20 is 100 mm, the diameter of the X-ray blocking member 23 and the diameter of the exit-side opening end 21 are 0.6 mm. That is, a y-coordinate y1 at the point P1 is 0.3 mm, and the total reflected optimal angle θc is 3 mrad. In addition, the total reflected optimal angle θc may be varied in accordance with energy of X-rays and the like. In this case, the energy of X-rays is approximately 10 keV, for example.

Under the conditions described above, the following values can be obtained: a=0.00045 mm from the equation (4); x1=50 mm from $x1=y1^2/4a$; y2=0.52 mm from the equation (5); S=50.0 mm that is a working distance WD from the equation (6); and the X-ray convergence efficiency E=66.7% from the equation (7). In addition, if used in a radiation light facility, and a luminance of the entered X-rays is set to $10^{12}$ photon/sec/mm$^2$, by narrowing the diameter of the entered X-rays to 1 μm, $7\times10^{17}$ photon/sec/mm$^2$ can be realized.

Alternatively, assuming that the length L of the capillary 20 is 100 mm, and the diameter of the X-ray blocking member 23 and the diameter of the exit-side opening end 21 are 0.6 mm. That is, a y-coordinate y1 at the point P1 is 0.3 mm, and the total reflected optimal angle θc is 4 mrad. In addition, the total reflected optimal angle θc may be varied in accordance with the energy of X-rays and the like. In this case, the energy of X-rays is approximately 7.5 keV, for example.

Under the conditions described above, the following values can be obtained: a=0.00060 mm from the equation (4); y2=0.574 mm from the equation (5); S=37.5 mm that is the working distance WD from the equation (6), and the X-ray convergence efficiency E=72.7% from the equation (7).

As described above, if X-rays with less energy are used (i.e., the total reflected optimal angle θc is greater), the working distance WD from the output point to the focal position is shorter, while the X-ray convergence efficiency is improved. On the other hand, if X-rays with greater energy are used (i.e., the total reflected optimal angle θc is smaller), the working distance WD is greater, while the X-ray convergence efficiency is degraded. These values are merely examples, and they may be arbitrarily set to obtain the desired working distance WD and X-ray convergence efficiency. In any case, the working distance WD can be sufficiently ensured, while converging the X-rays onto the sample with high efficiency.

Figure 4B:
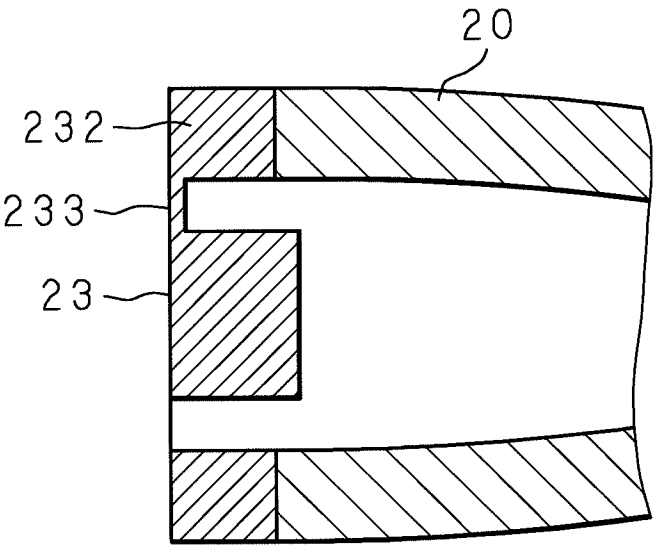
FIGS. 4A and 4B are views showing a shape of an X-ray blocking member.
Figure 4A:
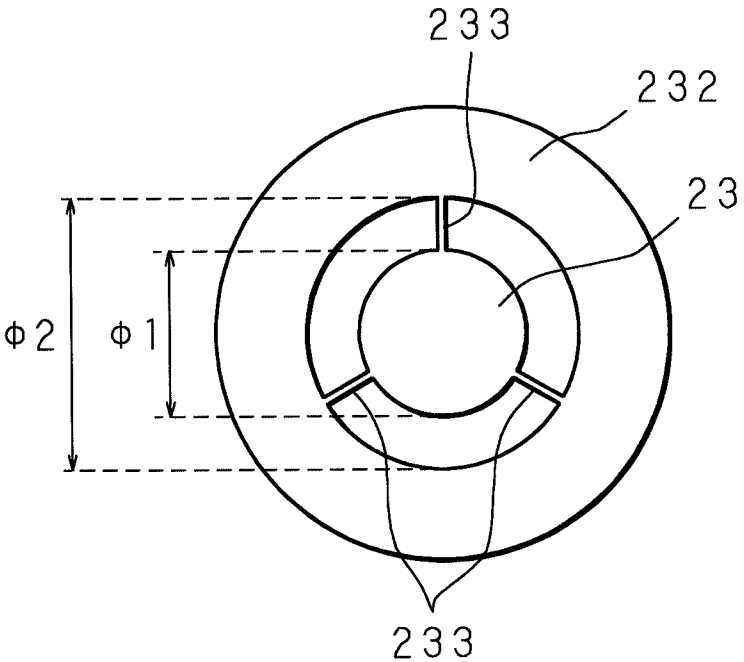

FIGS. 4A and 4B are views showing a shape of the X-ray blocking member 23. FIG. 4A shows a front view of the X-ray blocking member 23, and FIG. 4B shows a longitudinal cross-sectional view thereof. The X-ray blocking member 23 is provided with three supporting members 233 for supporting the X-ray blocking member 23 so as to extend from an annular member 232 having approximately the same diameter as the diameter of the entrance-side opening end 22 (outer diameter of the capillary 20) toward the center of the X-ray blocking member 23. The annular member 232 is fixed to the capillary 20. as follows:

The annular member 232, the supporting members 233, and the X-ray blocking member 23 may be integrally formed of a metal that shields the X-rays, such as tantalum, tungsten, and molybdenum. A dimension in the axial direction (thickness) of the X-ray blocking member 23 is set to be sufficient for blocking the X-rays. It is preferable that areas of the supporting members 233 with respect to the X-ray incident surface are as small as possible so that the entering X-rays are not interrupted. In addition, in order to ensure a sufficient strength to support the X-ray blocking member 23, the supporting members 233 may be narrow stick-like shapes, and arranged so as to have 120 degrees with each other about the center axis. The number of the supporting members 233 is not limited to three, and two, or four or more members may be used. However, for the strength and the reduction of the X-ray interruption, three members may be suitable. The shape of the X-ray blocking member is not limited to that of the embodiment described above, and may be in other shapes.

Embodiment 2

Figure 5B:
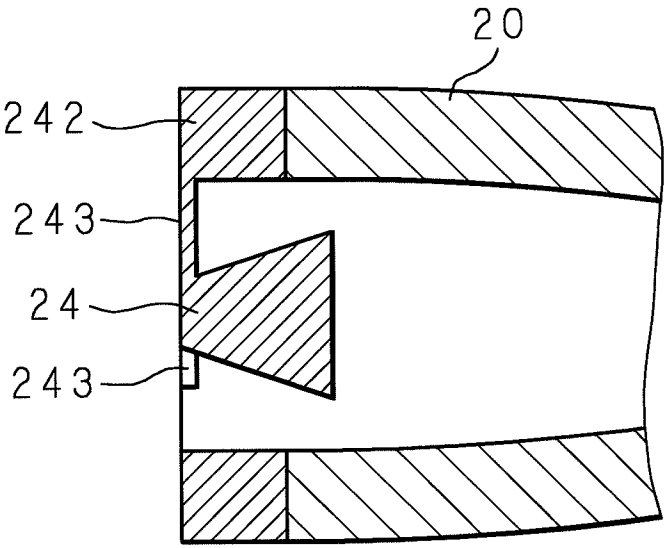
FIGS. 5A and 5B are views showing another shape of the X-ray blocking member.
Figure 5A:
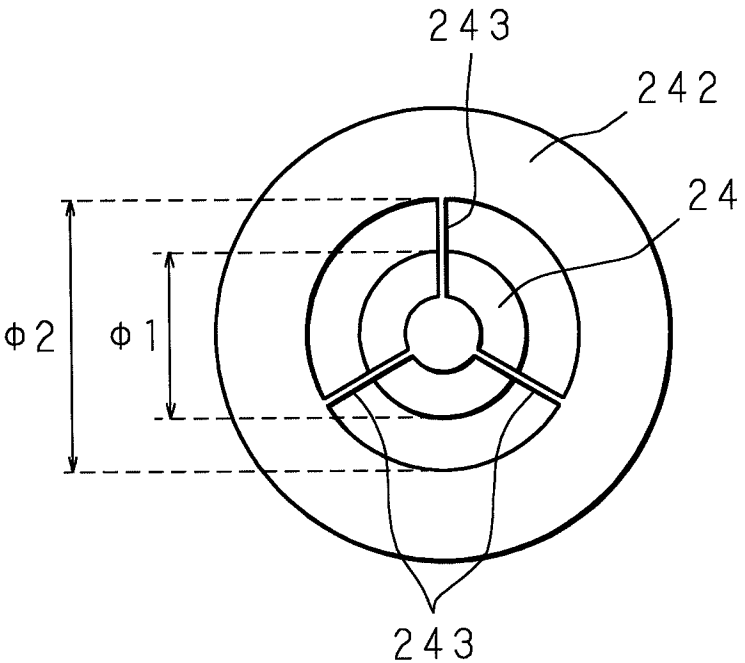

FIGS. 5A and 5B are views showing another shape of the X-ray blocking member. FIG. 5A shows a front view of the X-ray blocking member 24, and FIG. 5B shows a longitudinal cross-sectional view thereof. A difference from Embodiment 1 is that the diameter of the X-ray blocking member 24 is narrowed toward the X-ray entering side.

The X-ray blocking member 24 is provided with three supporting members 243 for supporting the X-ray blocking member 24 so as to extend from an annular member 242 having approximately the same diameter as the diameter of the entrance-side opening end 22 (outer diameter of the capillary 20) toward the center of the X-ray blocking member 24. The annular member 242 is fixed to the capillary 20. In this case, when the entered X-rays from the entrance-side opening end 22 are reflected on a side surface of the X-ray blocking member 24 approximately in the axial direction, traveling directions of the entered X-rays are significantly changed, and thereby preventing unnecessary scattered X-rays reflected on the X-ray blocking member 24 from entering into the capillary 20.

Embodiment 3

Figure 6B:
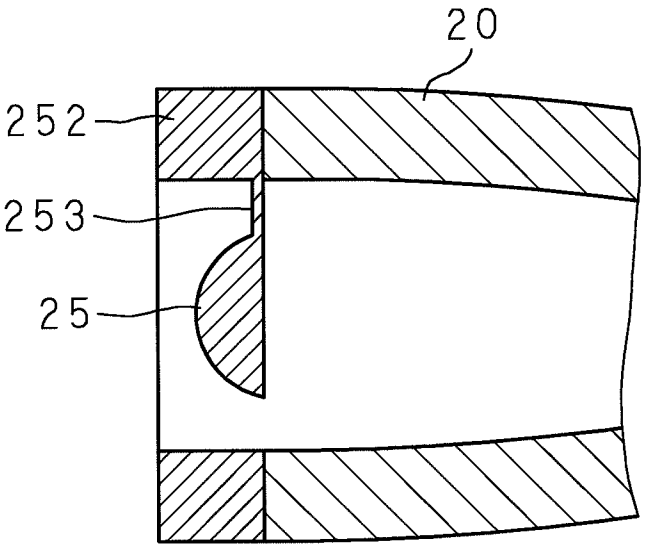
FIGS. 6A and 6B are views showing still another shape of the X-ray blocking member.
Figure 6A:
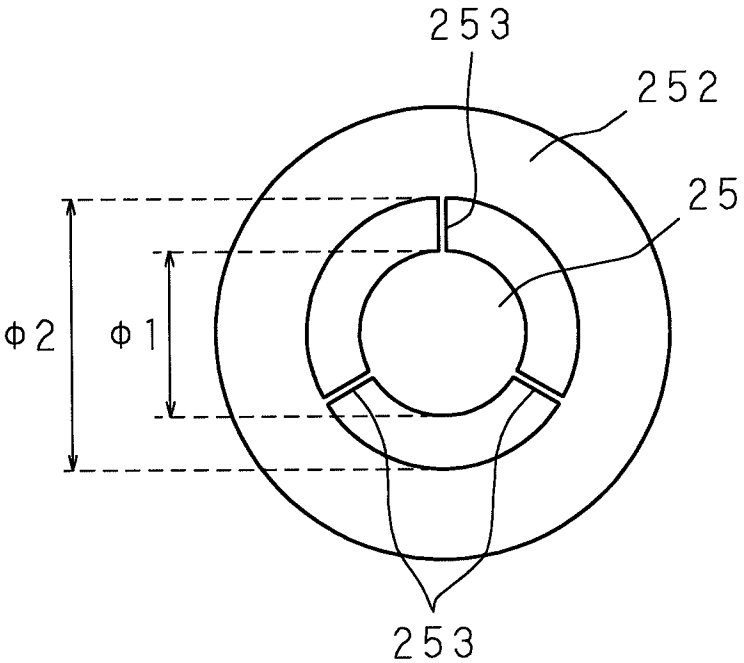

FIGS. 6A and 6B are views showing still another shape of the X-ray blocking member. FIG. 6A shows a front view of the X-ray blocking member 25, and FIG. 6B shows a longitudinal cross-sectional view thereof. A difference from Embodiment 1 is that an X-ray incident surface of the X-ray blocking member 25 forms a part of a spherical surface.

The X-ray blocking member 25 is provided with three supporting members 253 for supporting the X-ray blocking member 25 so as to extend from an annular member 252 having approximately the same diameter as the diameter of the entrance-side opening end 22 (outer diameter of the capillary 20) toward the center of the X-ray blocking member 24. The annular member 252 is fixed to the capillary 20. In this case, the X-rays entering from the entrance-side opening end 22 can be blocked without being reflected on the side surface of the X-ray blocking member 25 approximately in the axial direction. Therefore, the unnecessary scattered X-rays reflected on the X-ray blocking member 25 can be prevented from entering into the capillary 20.

Embodiment 4

Figure 7B:
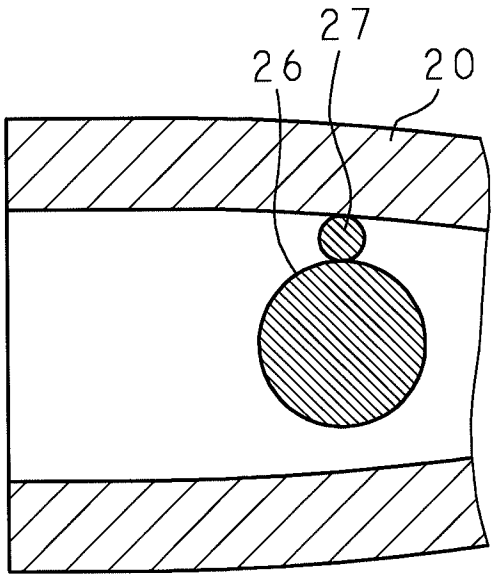
FIGS. 7A and 7B are views showing another shape of the X-ray blocking member.
Figure 7A:
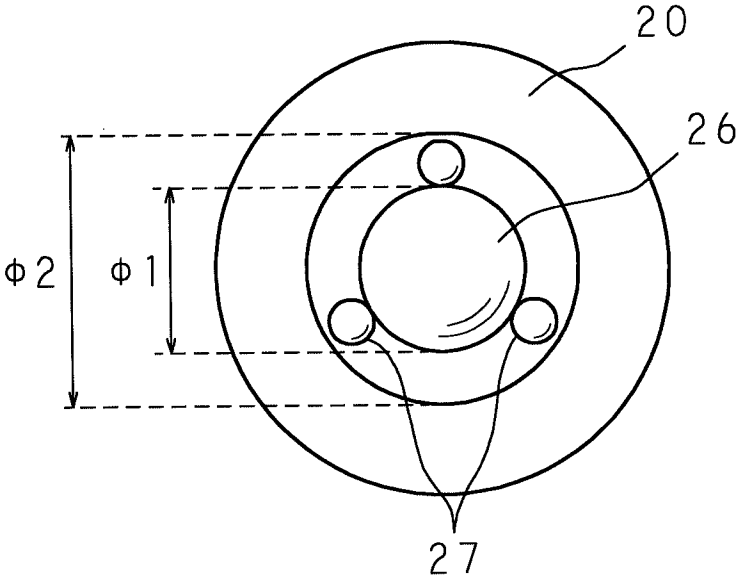

FIGS. 7A and 7B are views showing another shape of the X-ray blocking member. FIG. 7A shows a front view of the X-ray blocking member 26, and FIG. 7B shows a longitudinal cross-sectional view thereof. A difference from Embodiment 1 is that the X-ray blocking member 26 is formed in a spherical body, and spherical fixing members 27 are used instead of the supporting members 233.

The X-ray blocking member 26 is made of a metal, such as tantalum, tungsten, or molybdenum, and has the same diameter as the diameter $\phi$1 of the exit-side opening end 21. The fixing members 27 are spherical bodies having smaller diameters than the diameter of the X-ray blocking member 26, and are arranged so as to be spaced from each other with a predetermined distance in the circumferential direction of the capillary 20. Therefore, the center of the X-ray blocking member 26 is located on the center axis of the capillary 20.

Because the X-rays entering from the entrance-side opening end 22 are blocked without being reflected on the side surface of the X-ray blocking member 26 approximately in the axial direction, the unnecessary scattered X-rays reflected on the X-ray blocking member 26 are prevented from entering into the capillary 20. In addition, it is preferable that the diameters of the fixing members 27 may be as small as possible so that the entering X-rays are not interrupted. The fixing members 27 can be arranged so as to have 120 degrees from each other about the center axis. The number of the fixing members 27 is not limited to three, and, thus, two, or four or more members may also be used.

Embodiment 5

Figure 8B:
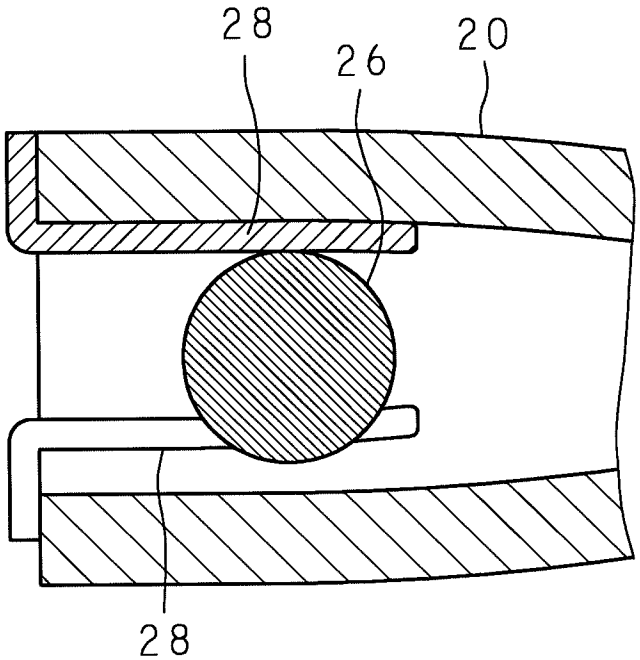
FIGS. 8A and 8B are views showing another shape of fixing members.
Figure 8A:
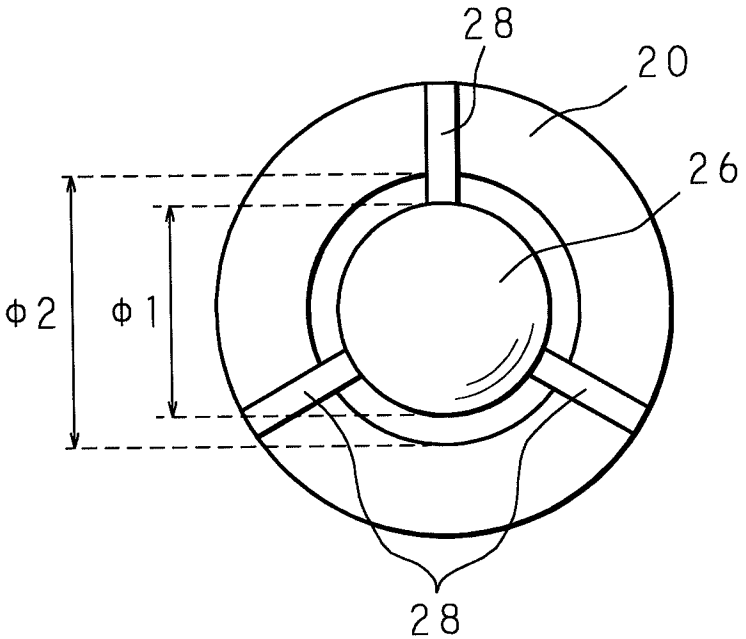

The shape of the fixing member 27 is not limited to that of Embodiment 4 described above, and may be in other shape. FIGS. 8A and 8B are views showing another shape of the fixing member. Particularly, FIG. 8A shows a front view of the fixing members 28, and FIG. 8B shows a longitudinal cross-sectional view thereof. A difference from Embodiment 4 is that fixing members 28 are stick-like bodies, instead of the spherical bodies.

The fixing members 28 are spaced from each other with a predetermined distance in the circumferential direction of the capillary 20, and are the stick-like bodies arranged approximately parallel to the axial direction of the capillary 20. Therefore, the center of the X-ray blocking member 26 is arranged on the center axis of the tubular body.

Because the X-rays entering from the entrance-side opening end 22 are blocked without being reflected on the side surface of the X-ray blocking member 26 approximately in the axial direction, the unnecessary scattered X-rays reflected on the X-ray blocking member 26 can be prevented from entering into the capillary 20. In addition, it is preferable that a thickness of the fixing member 28 is as thin as possible so that the entering X-rays are not interrupted, and the fixing members 28 can be arranged so as to have 120 degrees from each other about the center axis. The number of the fixing members 28 is not limited to three, and, thus, two, or four or more members may also be used.

Embodiment 6

Figure 9B:
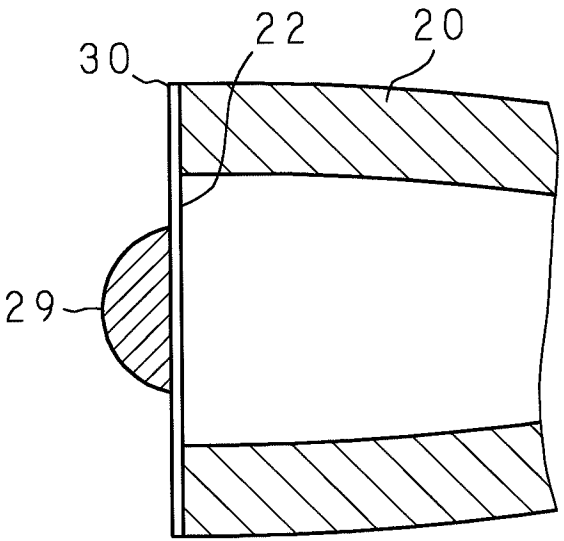
FIGS. 9A and 9B are views showing another example of fixture of the X-ray blocking member.
Figure 9A:
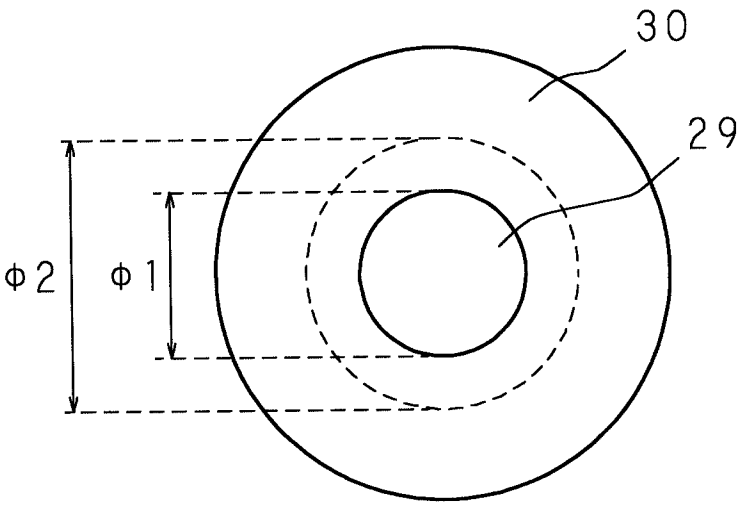

A fixation method of the X-ray blocking member is not limited to those of Embodiments 1 to 5, and other fixation methods may also be used. FIGS. 9A and 9B are views showing another example of fixation of the X-ray blocking member. FIG. 9A shows a front view of the X-ray convergence element 2, and FIG. 9B shows a longitudinal cross-sectional view of the X-ray convergence element 2. In these figures, a reference numeral 30 indicates a resin film with a high X-ray transmittance (e.g., PET sheet or the like). The resin film 30 is adhered to the entrance-side opening end 22 of the capillary 20. In a central portion of the resin film 30, a half-spherical X-ray blocking member 29 having the same diameter as the diameter $\phi$1 of the exit-side opening end 21 is fixed so as to protrude outwardly from the entrance-side opening end 22.

A position of the resin film 30 may be adjusted so that the center of the X-ray blocking member 29 is easily located on the center axis of the capillary 20. In this case, by using the resin film 30 with a high X-ray transmittance, the X-rays entering from the entrance-side opening end 22 can be blocked by the X-ray blocking member 29, while necessary X-rays pass through the resin film 30. Therefore, more X-rays can be converged.

In Embodiment 6 described above, the structure in which the X-ray blocking member 29 is arranged so as to protrude outwardly from the entrance-side opening end 22 with respect to the resin film 30 has been described, but it is not limited to this structure. A structure in which the X-ray blocking member 29 is arranged so as to protrude inwardly from the entrance-side opening end 22 with respect to the resin film 30 may also be applied.

As explained above, according to an aspect of the present invention, the diameter $\phi$2 of the entrance-side opening end 22 of the capillary 20 is greater than the diameter $\phi$1 of the exit-side opening end 21. Further, the X-ray blocking member is provided so that the center thereof is arranged on the center axis of the capillary 20, and the X-ray blocking member has the same diameter as the diameter $\phi$1 of the exit-side opening end 21, with respect to the center axis. Therefore, the incoming X-rays do not directly leave from the exit-side opening end 21 without being reflected on the inner surface of the capillary 20. Thus, the diameter $\phi$1 of the exit-side opening end 21 can be increased, and the working distance from the exit-side opening end 21 to the sample 13 can be extended.

In the result, the X-ray convergence element that can converge X-rays with high efficiency can be realized with a simple structure.

In addition, by extending the working distance of the X-ray convergence element, X-rays can be irradiated at a desired position of the sample even if the sample has a rough surface. Thus, a sufficient takeoff angle of the fluorescent X-rays emitted from the sample can be ensured. Further, the sample can be rotated by a desired angle or moved for a desired distance. Therefore, An X-ray analyzing device that can perform an analysis of the sample, the fluorescent X-ray analysis, and the X-ray diffraction analysis can be realized regardless of a size of the sample.

In Embodiment described above, although the structure in which the X-ray blocking member is arranged in proximity to the entrance-side opening end 22 has been described, the position of the X-ray blocking member on the axis of the capillary is not limited to this structure. The X-ray blocking member may be arranged between an X-ray source and the capillary, and may also be in any position inside the capillary. For example, the capillary may be divided into two pieces at an intermediate portion, the X-ray blocking member may be provided in proximity to an opening end of one piece of the capillary, and the divided pieces of the capillary may be fixed.

In Embodiment described above, the structure in which the X-rays parallel to the axis of the capillary 20 enter from the entrance-side opening end 22 of the capillary 20 to converge the X-rays has been described. However, the inner surface of the capillary may be formed in a rotating paraboloid or a rotating ellipsoid, and an X-ray source of a point source is located at one focal position. Thus, incoming X-rays from the X-ray source are totally reflected on the inner surface of the capillary to be parallel X-rays, and the parallel X-rays are again totally reflected on the inner surface of the capillary to be converged at the other focal position. In addition, the X-ray blocking member having approximately the same diameter as that of the entrance-side opening end is arranged inside the capillary, and X-rays directly passing through from the entrance-side opening end to the exit-side opening end are blocked.

In Embodiment described above, although the example in which the X-ray convergence element 2 is adopted for the X-ray analyzing device has been described, application of the X-ray convergence element is not limited to this example. For example, it may be applied to a photoelectron microscope in which a converged X-ray beam is irradiated onto a sample, and photoelectrons emitted from the sample are measured. In this case, because the X-ray beam can be converged at the microscopical focal point with high efficiency, an X-ray density can be increased, and a real-time observation of the sample can be performed at a higher rate compared to a conventional observation method. In addition, other than the above applications, the X-ray convergence element may be applied to an X-ray irradiation device for irradiating X-rays, such as an X-ray lithography, a device for causing a chemical reaction by using X-rays, and an irradiating-side lens of an X-ray microscope.

What is claimed is:

1. An X-ray convergence element, in which X-rays entering from an entrance-side opening end of a tubular body are reflected on an inner surface of the tubular body, and the reflected X-rays exit from an exit-side opening end of the tubular body while being converged, the X-ray convergence element, comprising:

an X-ray blocking member positioned adjacent the entrance-side opening end, having a diameter smaller than a diameter of the entrance-side opening end, a thickness of the X-ray blocking member, along a central axis of the tubular body, being different in a radial direction, and the center of the X-ray blocking member being arranged on the center axis of the tubular body, wherein a configuration of the varying side radial surface of the X-ray blocking member reflects incident X-rays to be equal to or greater than a total reflected optimal angle of the inner surface of the tubular body to enable reflected X-rays to pass through the tubular body.

2. The X-ray convergence element according to claim 1, further comprising:

an annular member fixed in proximity to the entrance-side opening end; and a plurality of supporting members extending from the annular member toward the center of the X-ray blocking member to support the X-ray blocking member.

3. The X-ray convergence element according to claim 2, wherein the X-ray blocking member is an elongated plate-like body, a diameter of which being narrowed toward the X-ray entering side along the center axis.

4. The X-ray convergence element according to claim 2, wherein the X-ray blocking member has an X-ray incident surface that is a part of a spherical surface.

5. The X-ray convergence element according to claim 1, wherein the X-ray blocking member forms a spherical body;

further comprising a plurality of fixing members for fixing the X-ray blocking member to the tubular body between the inner surface of the tubular body and a surface of the X-ray blocking member.

6. The X-ray convergence element according to claim 5, wherein the fixing members are spaced from each other with a predetermined distance in the circumferential direction of the tubular body, and are stick-like bodies arranged approximately parallel to each other in the axial direction of the tubular body.

7. The X-ray convergence element according to claim 1, further comprising an X-ray transmitting sheet for fixing the X-ray blocking member at the entrance-side opening end.

8. An X-ray irradiation device, comprising:

the X-ray convergence element according to claim 1 for converging X-rays irradiated from an X-ray source; and an irradiating unit for irradiating the X-rays converged by the X-ray convergence element.

9. An X-ray convergence element in which X-rays entering from an entrance-side opening end of a tubular body are reflected on an inner surface of the tubular body, and the reflected X-rays exit from an exit-side opening end of the tubular body while being converged, the X-ray convergence element comprising:

an X-ray blocking member having a diameter smaller than a diameter of the entrance-side opening end, a thickness of the X-ray blocking member, along a central axis of the tubular body, being different in a radial direction, and wherein the X-ray blocking member forms a spherical body further comprising a plurality of fixing members for fixing the X-ray blocking member to the tubular body between the inner surface of the tubular body and a surface of the X-ray blocking member, wherein the fixing members are spherical bodies arranged so as to be spaced from each other in the circumferential direction of the tubular body.

10. An X-ray convergence element, in which X-rays entering from an entrance-side opening end of an elongated glass tubular body are reflected on an inner surface of the elongated glass tubular body, and the reflected X-rays exit from an exit-side opening end of the elongated glass tubular body while being converted, the X-ray convergence element comprising:

an X-ray blocking member, positioned adjacent the entrance-side opening end, having a diameter smaller than a diameter of the opening end, a thickness of the X-ray blocking member, along a central elongated glass axis of the tubular body, being different in a radial direction, and the center of the X-ray blocking member being arranged on the center axis of the elongated glass tubular body wherein a configuration of the varying side radial surface of the X-ray blocking member reflects incident X-rays to be equal to or greater than a total reflected optimal angle of the inner surface of the elongated glass tubular body to enable reflected X-rays to pass through the elongated glass tubular body.

11. An X-ray convergence element, in which X-rays entering from an entrance-side opening end of an elongated glass tubular body are reflected on an inner surface of the elongated glass tubular body, and the reflected X-rays exit from an exit-side opening end of the elongated glass tubular body while being converted, the X-ray convergence element comprising:

an X-ray blocking member, positioned adjacent the entrance-side opening end, having a diameter smaller than a diameter of the opening end, a thickness of the X-ray blocking member, along a central axis of the elongated glass tubular body, being different in a radial direction, and the center of the X-ray blocking member being arranged on the center axis of the elongated glass tubular body wherein a configuration of the varying side radial surface of the X-ray blocking member reflects incident X-rays to be equal to or greater than a total reflected optimal angle of the inner surface of the elongated glass tubular body to enable reflected X-rays to pass through the elongated glass tubular body; and means for positioning the X-ray blocking member at the entrance-side opening of the elongated glass tubular body including an annular metal flange mounted on the entrance-side opening end to suspend the X-ray blocking member across the entrance-side opening end.

* * * * *

UNITED STATES PATENT AND TRADEMARK OFFICE

CERTIFICATE OF CORRECTION

PATENT NO. : 8,416,921 B2
APPLICATION NO. : 12/280136
DATED : April 9, 2013
INVENTOR(S) : Nakazawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 418 days.

Signed and Sealed this
Twenty-fifth Day of March, 2014

Michelle K. Lee

Michelle K. Lee
*Deputy Director of the United States Patent and Trademark Office*